United States Patent [19]

Heimlich et al.

[11] Patent Number: 4,782,980

[45] Date of Patent: Nov. 8, 1988

[54] CAPSULE DISPENSER

[75] Inventors: Philip F. Heimlich, Coral Springs; Barry N. Heimlich, Hollywood, both of Fla.

[73] Assignee: hiMedics, Inc., Hollywood, Fla.

[21] Appl. No.: 525

[22] Filed: Jan. 5, 1987

[51] Int. Cl.[4] ..... B65G 59/00

[52] U.S. Cl. ..... 221/265; 221/203; 222/370

[58] Field of Search ..... 221/4, 152, 167, 168, 221/203, 246, 263, 264, 265, 262, 288, 154, 169, 202, 204; 206/528, 534, 536, 538, 540; 222/367, 370, 452, 153, 404; 215/216, 223; 220/253, 329

[56] References Cited

U.S. PATENT DOCUMENTS 3,204,800 9/1965 Bugla et al. ..... 215/223
3,863,804 2/1975 Infante-Diaz et al. ..... 221/263 X
4,544,063 10/1985 Neward ..... 206/540
4,611,727 9/1986 Graff ..... 221/265 X

*Primary Examiner*—Joseph J. Rolla
*Assistant Examiner*—David H. Bollinger
*Attorney, Agent, or Firm*—Hayes & Reinsmith

[57] ABSTRACT

A dispenser for capsules or the like utilizes a turnstile member rotatable in only a single direction to transport the capsules from a reservoir to an exit port. Fingers on the turnstile arms interleave with corresponding fingers on the dispenser housing to prevent a capsule from being rotated beyond the exit port and back into the housing. A propeller member in the reservoir orients the capsules in a predetermined orientation before they are fed into the turnstile member. A cap on the exterior of the housing which rotates the turnstile member utilizes a bayonet-type detent mechanism to bias the cap into successive dispensing positions. The cap must be pushed toward the housing to be rotatable to the next dispensing position.

35 Claims, 5 Drawing Sheets

CAPSULE DISPENSER

BACKGROUND OF THE DISPENSER

This invention relates to a device for dispensing medication-containing capsules or the like, and, in particular, to a hand held and operable device for dispensing controlled quantities for such capsules.

It is often desirable to have dispensing devices for medication-containing capsules or the like which provide tamper proof features to protect the integrity and purity of the contents. One type of dispensing device which has been proposed is disclosed in U.S. Pat. No. 4,611,727 to Graff which is directed to a tablet or capsule dispenser which includes a circular baffle member which receives tablets from a container into separate delivery compartments along the periphery of the baffle member. A one-way carousel rotating member has a opening which may be rotationally aligned with each of the baffle member delivery compartments to dispense the tablet received therein. The opening in the carousel member includes a radial wall approximately one-half the height of the tablet which cooperates with the baffle member delivery compartments to prevent the carousel member opening from being rotated beyond a tablet in a delivery compartment. This along with the one-way rotating feature prevents an entire tablet from being inserted back into the container through the carousel opening.

One problem with this and other prior art dispensing devices is that objects of still significant size may be reinserted into the dispenser, thus allowing for a significant degree of tampering to the product in the dispenser. Since capsules and other forms of medication often have significant aspects ratios of 1.5:1 or higher there is often also the problem present of effectively feeding these high aspect ratio capsules in a controlled manner and quantity from the dispenser. A further problem which may develop during dispensing is that breakage or other damage to the capsules may occur.

Given the drawbacks of the prior art, it is therefore a principal object of the present invention to provide a significantly improved tamper proof feature in a capsule dispensing device.

It is another object of the present invention to provide an improved capsule dispensing device which is economical to fabricate, easily operated and adaptable to a wide variety of capsule sizes.

It is a further object of the present invention to provide an improved capsule dispensing device which provides for environmental sealing of the capsules and is of such a size, shape and arrangement that the minimum of human effort is required to operate and handle it.

It is still another object of the present invention to provide a capsule dispenser which may accommodate capsules having any aspect ratio.

It is a further object of the present invention to provide a capsule dispensing device which reduces the possibility of damage or breakage to the capsule during operation and use.

Other objects will be in part obvious and in part pointed out in more detail hereinafter.

A better understanding of the objects, advantages, features, properties and relations of the invention will be obtained from the following detailed description and accompanying drawings which set forth an illustrative embodiment and is indicative of the way in which the principle of the invention is employed.

SUMMARY OF THE INVENTION

The present invention provides a dispenser for capsules or the like comprising a housing; a reservoir in the housing for containing a supply of the capsules, the reservoir having a first exit port sized to feed a controlled quantity of the capsules at a time out of the reservoir; a second exit port in the housing spaced apart from the first exit port to dispense the controlled quantity of the capsules fed from the first exit port out of the housing; and a turnstile member in the housing and relatively rotatable therewith between the first and second ports, the turnstile member having at least one radially extending arm defining at least one capsule-receiving chamber, each turnstile member arm having a plurality of fingers interleaving with corresponding fingers in the housing during a portion of rotation of the turnstile member, the turnstile member being relatively rotatable in a single direction between a first receiving position wherein the capsule-receiving chamber is in registry with the first exit port for receiving a controlled quantity of the capsules from the reservoir and a second dispensing position wherein the capsule-receiving chamber is in registry with the second exit port for dispensing the received controlled quantity of capsules from the housing, the corresponding interleaved turnstile member arm and housing fingers cooperating when the turnstile member capsule-receiving chamber is in the second dispensing position to block further rotation of the turnstile member back to the first receiving position in the single direction until the controlled quantity of capsules in the chamber dispensed through the second exit port.

The present invention also provides a dispenser for capsules or the like comprising a housing having a reservoir for containing supply of the capsules, a cap mounted on the housing and relatively rotatable therewith into first and second positions for dispersing the capsules, and detent means to detain the cap in at least first and second dispensing positions, the detent means comprising a continuous guiding slot about the circumference of one of the cap and housing; a plurality of detent knobs on the other of the cap and housing slidable in the guiding slot as the cap and housing are relatively rotated; a plurality of detent slots extending from the guiding slot for receiving the detent knobs and preventing rotation of the cap in the first and second positions; positive action detent means at the juncture of the guiding slot and at least one the detent slots for preventing movement of a detent knob in the preselected direction beyond the detent slot within first sliding at least partially into the detent slot; and means for biasing the cap to slide the detent knobs from the guiding slot at least partially into the detent slots, the cap being rotatable in the preselected direction to slide the detent knobs in the guiding slot until one of the detent knobs is stopped by the positive action detent means whereupon the cap biasing means biases the detent knobs into the detent slots thereby preventing further rotation of the cap, the cap being further rotatable by movement of the cap against the biasing means to slide the detent knobs into the guiding slot whereupon the cap is again rotatable in the preselected direction until one of the detent knobs is stopped by the positive action detent means.

DETAILED DESCRIPTION OF THE INVENTION

Figure 1:
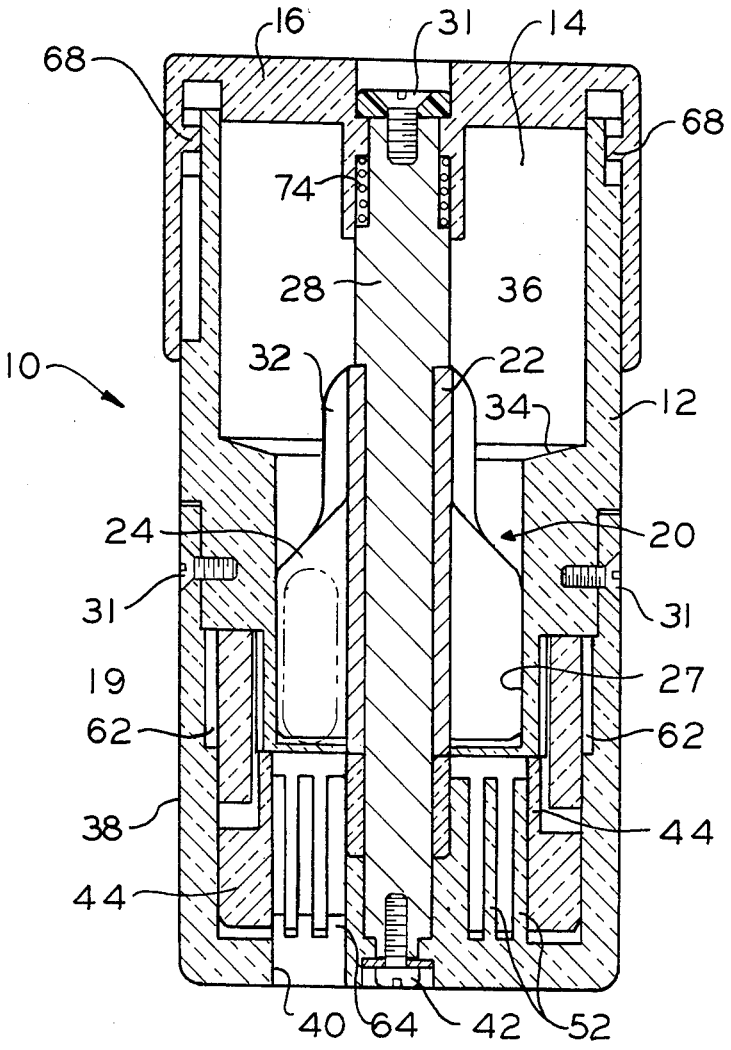
FIG. 1 is a longitudinal, cross-sectional view of the preferred embodiment of the dispenser of the present invention.

While the present invention is directed in its preferred embodiment to the dispensing of medication-containing capsules, it is to be understood that the term "capsule" is not to be regarded in this limiting sense unless it is so specifically designated. Furthermore, in addition to capsules, the present invention is useful for dispensing caplets, tablets or other like articles, which articles may be of either hard or soft configuration and may have solid, liquid or gel interiors. Directional terms are also used herein, but it is to be understood that such terminology is employed for convenience of description and is not be be regarded in any way in limiting the invention.

Referring to the drawings in greater detail wherein like reference numerals indicate like parts within the figures, a preferred embodiment of the device 10 is comprised of a minimum number of parts assembled into an integrated unit of a size to be readily grasped and held in one hand. The parts are preferable of moldable plastic material to afford light weight and economical construction.

As seen in FIG. 1 in a longitudinal cross section in its normal upright position, the cylindrical device 10 is comprised of an upper housing 12 defining the sides and bottom of a reservoir 14 for containing capsules, tablets, or other articles for dosing medicine or the like. A cap 16 coaxially mounted atop upper housing 12 environmentally seals the top of reservoir 14, and in this preferred embodiment, is normally non-removable by the consumer from the upper housing 12 after installation to restrict access to the capsules or other articles therein. It is anticipated that the dispensing device 10 be made to be thrown away after depletion of the reservoir. As will be explained below, cap 16 also provides for operation of dispenser 10 by rotation relative to housing 12.

Figure 2:
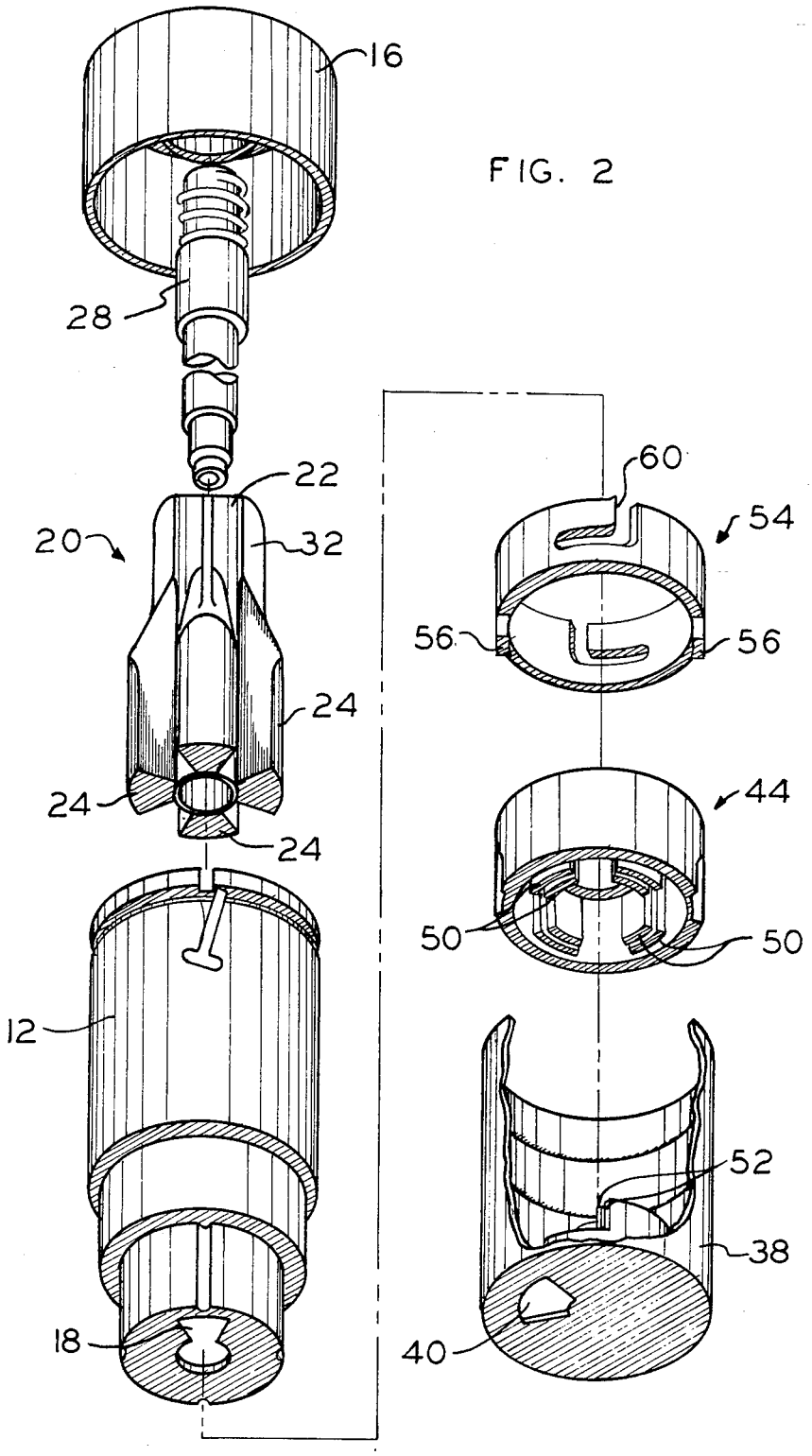
FIG. 2 is an exploded view, in perspective, of the dispenser of FIG. 1.
Figure 6:
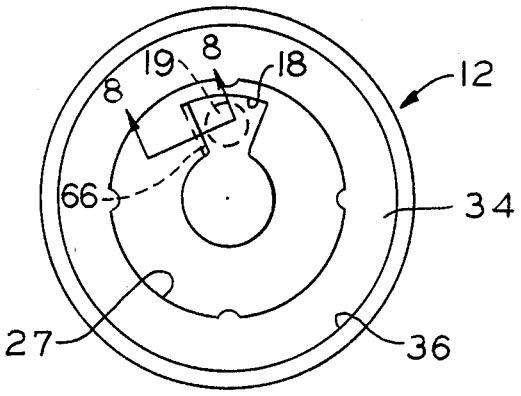
FIG. 6 is an axial view of the reservoir upper housing of the dispenser of FIG. 1.

To dispense capsules from reservoir 14 by gravity feed in the normal upright position of device 10, there is provided a reservoir exit port 18 at the lower end of upper housing 12, as best seen in the exploded perspective view in FIG. 2 and in an axial plan view in FIG. 6. Exit port 18 is sized to permit a capsule 19 to pass through in a longitudinal manner as shown in FIG. 6.

Since capsules and many other articles have an aspect ratio greater than 1:1, the preferred embodiment of the present invention provides means to vertically orient these capsules to permit them to pass out of reservoir 14 through exit port 18. As used herein, "aspect ratio" refers to the ratio of the article dimensions in either two or three dimensions. The capsule-like articles for which this preferred embodiment of device 10 is useful are those having an aspect ratio greater than 1:1 and especially over about 1.5:1 and up to about 3:1 or greater. These capsule-like articles can have a wide variety of elongated or other geometric shapes, especially those having axial symmetry, for example, cylinders having flat or rounded ends, football-like shapes having rounded or pointed ends, spheres, ellipsoids, parabaloids, or any shape defined by a surface of revolution about an axis.

Figure 3:
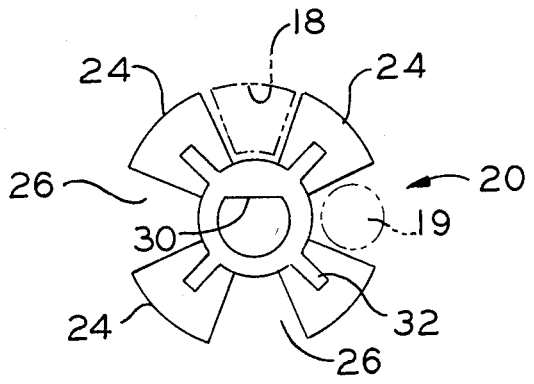
FIG. 3 is an axial view of the propeller member of the dispenser of FIG. 1.
Figure 4:
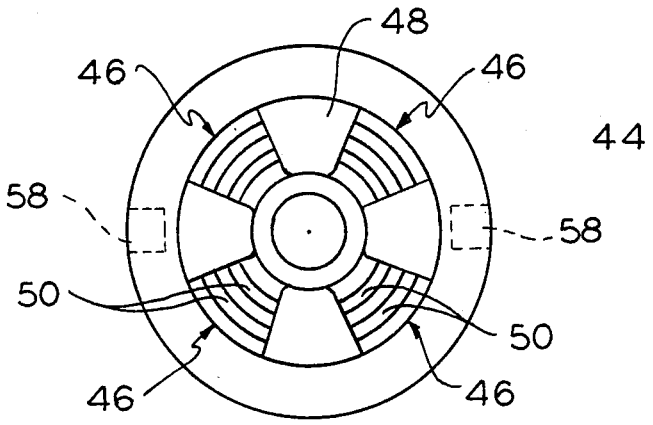
FIG. 4 is an axial view of the turnstile member of the dispenser of FIG. 1.

As seen in longitudinal, cross-sectional view in FIG. 1, perspective view in FIG. 2, and axial plan view in FIG. 3, propeller member 20 in the lower portion of reservoir 14 orients capsules having an aspect ratio greater than 1:1. Propeller member 20 has a cylindrical core member 22 from which four 90° spaced arms 24 extend radially outward to define four propeller capsule-receiving chambers 26 therebetween. Arms 24 extend radially outward toward the lower inner wall 27 of upper housing 12 and extend longitudinally a sufficient distance to cooperate with inner wall 27 to contain a capsule 19 in a vertical orientation. Propeller member 20 may have only one arm defining only one capsule-receiving chamber, or may alternatively have a plurality of arms and capsule-receiving chambers to contain a capsule in any desired orientation, for example, a horizontal orientation or any angle between horizontal and vertical.

To bring successive capsules into registry with exit port 18 so that they may be individually and controllably fed out of reservoir 14, propeller member 20 is rotatable about its core member 22. A rotatable shaft 28 extends through the longitudinal axis of device 10, as best seen in FIGS. 1 and 2, and is fitted coaxially through the propeller core member 22 having cooperating flat 30 to provide rotation thereto. Shaft 28 is coaxially fixed at its upper end by screw fastener 31 to cap 16 so that propeller member 20 may be rotated by grasping the lower exterior portion of device 10 with one hand and turning cap 16 with other hand.

The capsules contained in the upper portion of reservoir 14 will be normally in a random orientation. Prealignment of these randomly oriented capsules to enable them to fall vertically into capsule receiving chambers 26 is accomplished by the upper extensions 32 of arms 24 which provide agitation to the capsules in reservoir 14 as propeller member 20 is rotated by cap 16. Upper arm extensions 32 extend radially outward to a lesser degree than arms 24 and are arcuate in form as they merge with the top of propeller member 20 and propeller arms 24. Laterally adjacent to arm extensions 32 there is a non-horizontal, gradually inward-sloping stepped surface 34 between upper inner wall 36 and lower inner wall 27 of upper housing 12. As shown in this preferred embodiment, stepped surface 34 has a radial width approximately equivalent to the width of the capsules to be contained in the reservoir 14, and further has a slope of about 7° to horizontal. As propeller member 20 is rotated to agitate the capsules in reservoir 14, the capsules tend to prealign in a near vertical orientation on stepped surface 34 and are able to slide inward to fall and be received in chambers 26 between propeller member arms 24.

Mounted coaxially and non-rotationally to the lower portion of upper housing 12 by fasteners 31 is lower housing 38 which contains dispenser exit port 40 below and non-aligned with reservoir exit port 18. As would be seen in a comparative axial view, not shown, but which may be appreciated in the exploded perspective view in FIG. 2, dispenser exit port 40 is 90° offset from reservoir exit port 18, relative to an axial line running through shaft 28. Dispenser exit port 40 may be provided with an environmental seal (not shown) of any conventional design to prevent contaminants from entering the dispenser device 10 when capsules are not being dispensed. The lower end of shaft 28 is rotatably secured to lower housing 38 by fastener 42, as shown in FIG. 1.

To transfer a capsule dispensed from reservoir exit port 18 to dispenser exit port 40 from which it may be gravity fed out of device 10 there is provided a turnstile member 44 rotatably disposed in lower housing 38 between the exit ports 18 and 40. As shown in this preferred embodiment, turnstile member 44 includes four 90° angularly spaced arms 46 extending radially from shaft 28 which define four complimentary turnstile capsule-receiving chambers 48. Turnstile member 44 is coaxially fixed to shaft 28 and rotatable therewith by turning of cap 16 to transfer a capsule received in a turnstile chamber 48 from exit port 18 in its vertical orientation through a 90° rotation with respect to shaft 28 into registry with exit port 40 where it may fall out of the dispenser 10. As the capsules in the turnstile member 44 are transported from the receiving position to the dispensing position, they are maintained in the same orientation relative to the axis of rotation of the turnstile member. Propeller member 20 and turnstile member 44 are preferably relatively oriented so that their respective arms and capsule remaining chambers are longitudinally aligned.

Instead of sizing the propeller member chambers 26, reservoir exit port 18, turnstile member chambers 48, and dispenser exit port 40 to receive and pass a single capsule at a time, they may be sized to receive and pass any other desired controlled quantity of capsules.

While in the preferred embodiment of the present invention dispenser exit port 40 is located below reservoir exit port 18 to permit gravity feeding therebetween in the normal upright position of dispenser 10, it is also contemplated that exit ports 18 and 40 may be located in some different relative orientation, for example, in approximately the same radial or horizontal plane so that feeding of a capsule therethrough is effected, for example, by tilting of the dispenser 10 or by other mechanical means.

Figure 7:
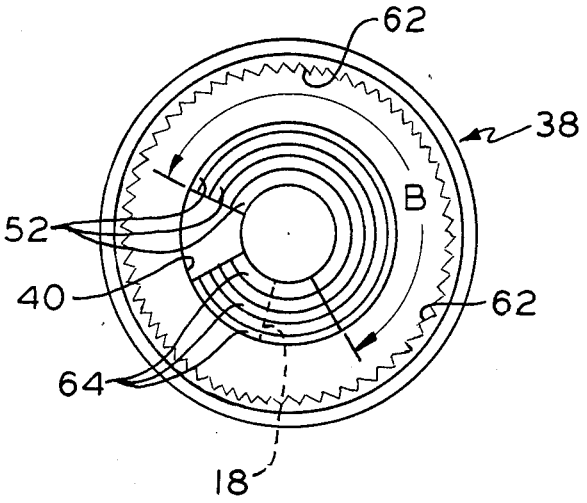
FIG. 7 is an axial view of the lower housing of the dispenser of FIG. 1.

A "no-back" ratchet means is also provided to restrict rotation of turnstile member 44 in single preselected direction in the 90° arc between reservoir exit port 18 and dispenser exit port 40. As shown in FIG. 2, ratchet member 54 has bosses 56 which extend downward and fit into complementary notches 58 in turnstile member 44 so that ratchet member 54 and turnstile member 44 rotate together. Tooth 60 extends radially outward from ratchet member 54 and is spring loaded to be urged against and into complimentary saw tooth shaped splines 62, as seen in FIG. 7, along the inner wall of lower housing 38. The individual teeth of splines 62 have opposite sharp and shallow angled faces so that when ratchet member 60 is rotated in one direction tooth 60 may ride up and out of each tooth along the shallow angle. When an attempt is made to rotate ratchet member 60 in the direction opposite to said preselected direction, tooth 60 may not ride out of the spline teeth along the sharp angled face and rotation is prevented. The number of splines 62 spaced uniformly inside lower housing 38 should be evenly divisible by the number of angularly spaced capsule-receiving chambers in turnstile member 44 and propeller member 20 to permit even registry of these chambers with exit ports 18 and 40.

This "no-back" ratchet arrangement prevents, for example, a capsule or other object from being inserted through dispenser exit port 40 into turnstile receiving chamber 48, rotated in a reverse direction into registry with reservoir exit port 18, and dropped back into reservoir 14 by inverting dispenser 10.

So that a capsule in one of turnstile chambers 48 may not be rotated by turnstile member 44 in the preselected direction beyond dispenser exit port 40 and back around into registry with reservoir port 18, each turnstile member arm 46 is comprised of a plurality of vertical fingers 50 which interleave with corresponding vertical lower housing fingers 52 over at least a portion of the rotational movement of each arm 46 beyond dispenser exit port 40 in the preselected direction. As shown in FIG. 7, the corresponding interleaving fingers 52 in lower housing 38 extend over angle "b" of approximately 225°, which corresponds roughly to the non-included angle encompassing dispenser exit port 40 and reservoir exit port 18 (shown in phantom lines). Housing fingers 52 should be at least adjacent to exit port 40 on the side away from the path of transfer of a capsule from reservoir exit port 18. In the preferred embodiment shown, the turnstile arm fingers 50 and lower housing fingers 52 are in close sliding abutment to restrict transfer of any contaminating material therebetween. While the interleaved turnstile and housing fingers are each shown to be vertical in the preferred embodiment, they may extend in any other direction, for example, in a horizontal direction.

Another tamper proof feature provided by the present invention is the angular separation of the reservoir exit port 18 and the dispenser exit port 40, which is shown as being approximately 90° between the centers of each port. This lateral angular separation of the two exit ports 18 and 40, coupled with the blocking presence of the fingers 50 of turnstile arm 46, serves to restrict the insertion of contaminants into reservoir 14 from dispenser exit port 40, for example, by sticking a needle or tube into dispensing exit port 40.

The 90° arc spacing of the four turnstile capsule-receiving chambers 48 corresponds to the 90° arc spacing between reservoir exit port 18 and dispenser exit port 40. Thus, when one turnstile capsule-receving chamber is in registry with dispenser exit port 40 another turnstile capsule-receiving chamber is in registry with reservoir exit port 18 to permit simultaneous feeding of capsules through both exit ports 18 and 40. The angular spacing between exit ports 18 and 40 can be any integer multiple of the angular spacing between turnstile capsule-receiving chambers to permit simultaneous feeding. In this manner, there will always be at least one turnstile arm 46 interpositioned between exit ports 18 and 40 to block insertion of contaminants therebetween. Preferably the fingers of each turnstile arm 46 extend over essentially all the space in the passageway between exit ports 18 and 40.

Thus, the present invention dispenser provides several advantages in preventing contamination to the contents of its reservoir by: (1) utilizing a "no-back" ratchet mechanism to prevent reintroduction of a capsule or other object through the exit port and reversing the turnstile mechanism; (2) spacing the reservoir and dispenser exit ports and utilizing the arms of the turnstile mechanism to block entry of a needle or the like; (3) utilizing complimentary, and preferably closely abutting, interleaving fingers of the turnstile arms and housing to prevent the turnstile mechanism from carrying a capsule or other object in the preselected direction back around from the dispenser exit port to the reservoir exit port; and (4) sealing the bulk storage reservoir to prevent access to the capsules therein.

Since capsules and other articles for which the present invention dispenser may be utilized are often fragile, the preferred embodiment of dispensing device 10 also incorporates features to protect the integrity of the capsule shell.

Figure 8:
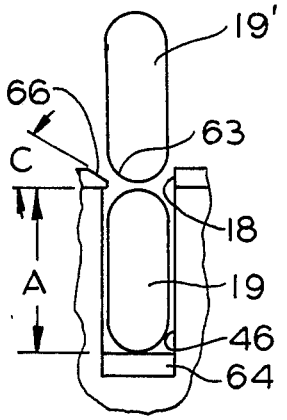
FIG. 8 is a longitudinal cross sectional view through the reservoir exit port of the dispenser of FIG. 1.

In the embodiment of the device 10 disclosed herein, turnstile capsule chamber 48 is of a height to receive and transfer a single capsule 19. The height of turnstile chamber 46 may be most easily changed by changing the height of the "floor" of lower housing 38 in the approximately 90° arc between the turnstile chamber registries with reservoir exit port 18 and dispenser exit port 40. As shown in longitudinal cross-section in FIGS. 1 and 8 and axially in FIG. 7, this "floor" comprises only partially interleaving housing figners 64 which may be changed to vary the height "a" of turnstile chamber 46. Should the height dimension "a" be changed to accommodate a capsule of different size, the other chamber dimensions should be changed if necessary so that the capsule is constrained in the desired orientation. As best seen in FIG. 8, this turnstile chamber 46 height dimension "a" should be selected so that it is at least the length of capsule 19 received in turnstile chamber 46, but is not so great as to allow the end curvature 63 of the next capsule 19', received in propeller chamber 26 and resting on capsule 19, from extending below the radial plane of the lip of reservoir exit port 18. To prevent capsule 19' from being pinched by the lip of exit port 18 as propeller member 20 and turnstile member 44 are simultaneously rotated in the preselected direction, a beveled portion 66 (FIGS. 6 and 8) of angle "c" is provided on the lip of exit port 18 and forms a camming surface which so contacts capsule 19' to cooperate with capsule end curvature 63 and gently lift and push capsule 19' out of pinching position in the path of the exit port 18 lip. The included angle "c" of the beveled portion 66 shown in 30°, although any other suitable angle may be employed.

To provide a detent for registry of propeller chambers 26 and turnstile chambers 48 with reservoir exit port 18 and for registry of turnstile chambers 48 with dispenser exit port 40, and to prevent a capsule from being crushed against the interleaving lower housing fingers 52 by inadvertent rotation of a capsule in a turnstile chamber 48 beyond dispenser exit port 40, there is provided a "positive stop" and "positive action" detent means for dispenser 10.

This positive action detent means is intermittently activated and provides for partial rotation of cap 16 relative to upper housing 12 only after relative axial movement of cap 16 and upper housing 12. Cap member 16 fits over the top of and around the upper sides of upper housing 12 to environmentally seal reservoir 14. Four detent knobs 68 extend radial inwardly and are spaced at 90° intervals along a radial plane around the interior of cap member 16. Detent knobs 68 slide along a complementary shaped continuous guiding circumferential slot 70 around the exterior of upper housing 12 to permit rotation of cap members 16 and prevent its removal from upper housing 12. As stated earlier, cap 16 is secured to shaft 28 so that turning of cap 16 relative to housing sections 12 and 38 simultaneously rotates propeller member 20 and turnstile member 44 therein.

To provide detents for registry of the propeller chambers 26 and turnstile chambers 48 with the proper exit ports 18 and 40, four longitudinal detent slots 72' extend at 90° intervals from and above circumferential slot 70 to receive cap 16 detent knobs 68 at the proper relative angular orientations. A compression spring 74 along shaft 28 urges cap 16 upward to provide biasing means to bias detent knobs 68 axially upward into longitudinal slots 72 as they are turned along circumferential guiding slot 70 into registry therewith. When cap detent knobs 68 are disposed in longitudinal detent slots 72, one of propeller chambers 26 and turnstile chambers 48 are in registry with reservoir exit port 18. At the same time, another of the turnstile chambers 48 is in registry with dispenser exit port 40. Thus, a capsule from propeller chamber 26 may be gravity fed into a corresponding turnstile chamber 48 below, while simultaneously a capsule may be dispensed out of exit port 40.

By pushing cap 16 axially downward against spring 74 so that detent knobs 68 are again aligned with circumferential slot 70, cap 16 may be rotated 90° to bring the detent knobs 68 into axial alignment and registry with the next longitudinal detent slots 72, at which position the next set of propeller and turnstile chambers, 26 and 48 respectively, are in registry with reservoir exit port 18, and the turnstile chamber 46 which had received a capsule from the reservoir 14 in the previous detent position is now in registry with dispenser exit port 40 to allow that capsule to be dispensed. The number of longitudinal detent slots 72 and detent knobs 68 should correspond to the number of the propeller chambers 26 and turnstile chambers 48 to provide for proper registry of these capsule-receiving chambers with exit ports 18 and 40.

Figure 5:
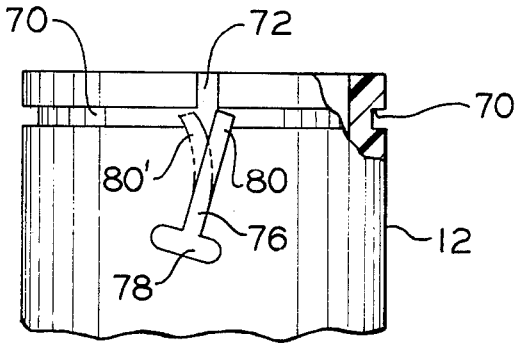
FIG. 5 is a longitudinal side view, partially in section, of the detent means utilized in the dispenser of FIG. 1.

To prevent the rotation of the cap and detent knob 68 past a longitudinal detent slot 72, a flexible spring bayonet 76 provides a positive stop. Spring bayonet 76 is mounted along the outer wall of upper housing member 12 and includes a head 78 mounted in a correspondingly shaped slot at the base of a "V" formed by two walls in the upper housing member 12. The upper opposite spring or flexible end 80 of bayonet 76 extends in a cantilever fashion into circumferential guiding slot 70 to provide a block to sliding of the detent knobs 68 therein. In its normal biased position, bayonet end 80 extends into circumferential guiding slot 70 at one side of the juncture of circumferential guiding slot 70 and longitudinal slot 72'. In the embodiment shown in FIG. 5, bayonet end 80 is to the right of longitudinal slot 72'. In this normal biased position, bayonet end 80 permits one of detent knobs 68 to slide from a biased detent position in longitudinal slot 72' down into circumferential slot 70. Once in circumferential slot 70, a detent knob 68 may only slide toward the left as shown in FIG. 5 and is blocked by bayonet end 80 from sliding to the right. Thus, rotation of cap 16 is permitted in only one preselected direction following movement from a detent position, which direction should be the same as that preselected by ratchet member 54.

As cap 16 is rotated in the preselected direction, another detent knob 68 will approach bayonet end 80 from the right in circumferential slot 70. The walls within upper housing 12 on either side of the upper end of bayonet 76 form a "V" shape to allow bayonet end 80 to move to the left (as shown in phantom lines) when it is contacted by a detent knob 68 moving toward and against bayonet end 80 from the right. When bayonet end 80' is flexed to its extreme left position against and abutting the left wall of the "V", as shown in phantom lines FIG. 5, a detent knob 68 in circumferential slot 70 may then slide leftward from its position to the right of bayonet end 80 and be biased axially upward into longitudinal slot 72' by the force of compression spring 74. In its flexed position as shown in phantom lines, bayonet end 80 prevents a detent knob 68 from sliding in circumferential slot 70 beyond longitudinal slot 72'. Once a detent knob 68 is biased upward into longitudinal slot 72' and clear of bayonet end 80, bayonet end 80 is free to spring back and return to its normal biased condition against and abutting the right wall of the "V", which then again prevents reverse rotation of cap 16.

The spring bayonet in combination with the longitudinal slot detent positions thereby ensures that a positive action must be made to and against cap 16 before rotation of the propeller or turnstile chambers beyond their registry positions with their corresponding reservoir and dispenser exit ports. Thus, the "push and turn" motion required prevents a capsule in a turnstile chamber 48 from being rotated beyond dispenser exit port 40 before a sufficient pause to allow the capsule to fall out of the dispenser through exit port 40. This then prevents the inadvertent crushing of a capsule in registry with exit port 40 against the interleaving fingers 50 and 52 of the turnstile arms and housing, respectively.

The aforedescribed positive action spring bayonet detent means can be utilized in any dispenser or other device which utilizes detents to detain relative rotary motion of cap and housing members in different dispensing positions. In addition, the location of the detent knobs and guiding and detent slots can be reversed from the disclosed position on the cap and housing, respectively, so that the detent knobs are located on the housing and the slots are located on the cap.

As will be apparent to persons skilled in the art, various other modifications, adaptations and variations of the foregoing specific disclosure can be made without departing from the spirit and scope of this invention.

Having this described this invention what it claimed is:

1. A dispenser for capsules or the like comprising:

a housing;

a reservoir for capsules in said housing, said reservoir having a first capsule exit port;

a second capsule exit port in said housing spaced apart from said first exit port to dispense the capsules fed from said first exit port out of said housing; and a turnstile member rotatably supported in said housing to transport at least one capsule between said first port and said second port, said turnstile member having at least one radially extending arm defining at least a portion of one capsule-receiving chamber, each turnstile member arm having a plurality of fingers, said housing having a plurality of fingers positioned thereon to interleave with the fingers on said arm during a portion of the rotation of said turnstile member, said turnstile member being rotatable in a single preselected direction between a position with said turnstile member capsule-receiving chamber in registry with said first exit port along a path of transfer to a position with said turnstile member capsule-receiving chamber in registry with said second registry with said second exit port for dispensing capsules from said housing, the corresponding interleaved turnstile member fingers and housing fingers cooperating when said turnstile member capsule-receiving chamber is in said second dispensing position to block transfer of any capsule in said turnstile member in said preselected direction beyond said second exit port.

2. The dispenser of claim 1 wherein said first and second exit ports are non-aligned.

3. The dispenser of claim 1 wherein the fingers on the said turnstile member arm and the fingers on said housing are in sliding abutment when interleaved.

4. The dispenser of claim 1 wherein the housing fingers are positioned adjacent to said second exit port on that side of the exit port beyond the path of transfer of the capsule from said first exit port.

5. The dispenser of claim 1 wherein said reservoir and said turnstile member are coaxially aligned in said housing.

6. The dispenser of claim 1 including ratchet means for preventing relative rotation of said turnstile member and housing in a direction opposite to said preselected direction.

7. The dispenser of claim 1 further including means in said housing for orienting elongated capsules in a predetermined orientation prior to feeding said capsules from said reservoir out of said first exit port.

8. The dispenser of claim 7 wherein said turnstile member is adapted to maintain said predetermined capsule orientation between said first receiving position and said second dispensing position.

9. The dispenser of claim 7 wherein said capsule orienting means comprises a propeller member in said reservoir and rotatable relative thereto, said propeller member having at least one radially extending blade defining a capsule-receiving chamber for orienting said capsules in said predetermined orientation, said propeller member further having means for agitating capsules contained in said reservoir and gravity feeding the agitated capsules to the propeller member capsule-receiving chamber as said propeller member and reservoir are rotated, each propeller member capsule-receiving chamber forming a part of said propeller member being rotatable into registry with said first exit port.

10. The dispenser of claim 9 wherein said propeller member and said turnstile member are coaxially aligned.

11. The dispenser of claim 10 wherein the capsule-receiving chambers of said propeller member and said turnstile member are longitudinally aligned, and said propeller member and said turnstile member are rotatable in concert.

12. The dispenser of claim 11 wherein said first exit port includes a beveled lip portion to lift a capsule in the propeller member capsule-receiving chamber out of the path of said first exit port lip as said capsule is rotated by said propeller member blade beyond said first exit port.

13. The dispenser of claim 1 wherein said turnstile member has a plurality of arms defining a plurality of capsule-receiving chambers.

14. The dispenser of claim 13 wherein the turnstile member capsule-receiving chambers are angularly disposed about said turnstile member such that when a first turnstile member capsule-receiving chamber is in registry with said first exit port a second turnstile member capsule-receiving chamber is in registry with said second exit port.

15. The dispenser of claim 1 further including means accessible from the exterior of said housing for rotating said turnstile member.

16. The dispenser of claim 15 further including detent means to detain said turnstile member in said first and second positions.

17. The dispenser of claim 16 wherein the exterior accessible rotating means comprises a cap rotatable relative to said housing and fixed to the axis of said rotatable turnstile member, and said detent means comprises:

a continuous guiding slot about the circumference of said cap;

a plurality of detent knobs on the housing slidable in said guiding slot as said cap and housing are relatively rotated;

a plurality of detent slots extending from said guiding slot for receiving said detent knobs and preventing rotation of said cap when said turnstile member is in said first and second positions;

positive action detent means at the juncture of said guiding slot and at least one of said detent slots for preventing movement of a detent knob in said preselected direction beyond said detent slot without first sliding at least partially into said detent slot; and means for biasing said cap to slide said detent knobs from said guiding slot at least partially into said detent slots, said cap being rotatable in said preselected direction to slide said detent knobs in said guiding slot until one of said detent knobs is stopped by said positive action detent means whereupon said cap biasing means biases said detent knobs into said detent slots thereby preventing further rotation of said cap, said cap being further rotatable by movement of said cap against said biasing means to slide said detent knobs into said guiding slot whereupon said cap is again rotatable in said preselected direction until one of said detent knobs is stopped by said positive action detent means.

18. The dispenser of claim 17 wherein said positive action detent means further prevents movement of a detent knob beyond said detent slot in a direction opposite to said preselected direction.

19. The dispenser of claim 17 wherein said positive action detent means comprises a spring bayonet having a flexible end extending into said guiding slot at said juncture with said detent slot, said bayonet flexible end in a biased position being disposed at one side of said detent slot to permit a detent knob to slide from said detent slot and into said guiding slot in said preselected direction, said bayonet flexible end being movable by a detent knob sliding in said guiding slot in said preselected direction to a flexed position at the other side of said detent slot to permit a detent knob to be biased into said detent slot while preventing said detent knob from further movement in said guiding slot in said preselected direction.

20. The dispenser of claim 19 wherein said bayonet flexible end in said biased position prevents movement of a detent knob in said guiding slot beyond said detent slot in a direction opposite to said preselected direction.

21. The dispenser of claim 20 wherein two walls extend in a "V"-shape from said guiding slot in said one of said cap and housing and wherein said spring bayonet means is cantilever mounted at the base of said "V" shape, said spring bayonet being in abutment with the wall at one side of said "V" shape in said biased position, said spring bayonet being in abutment with the wall at the other side of said "V" shape in said flexed position.

22. A dispenser for capsules or the like comprising:

a housing;

a reservoir in said housing for containing a supply of said capsules, said reservoir having a first exit port sized to feed a single capsule at a time out of said reservoir;

a second exit port in said housing spaced apart from and non-aligned with said first exit port to dispense said capsule fed from said first exit port out of said housing;

a turnstile member in said housing and rotatable relative thereto in a preselected direction to transport along a path said capsule between said first and second ports, said turnstile member having at least one radially extending arm defining at least a portion of one capsule-receiving chamber, each turnstile member arm having a plurality of fingers, said housing having a plurality of fingers positioned to interleave with the turnstile fingers and adjacent to said second exit port on the upstream side beyond the path of transfer of said capsule from said first exit port; and ratchet means for preventing relative rotation of said turnstile member and housing in a direction opposite to said preselected direction, said turnstile member being relatively rotatable in said preselected direction between a first receiving position wherein said turnstile capsule-receiving chamber is in registry with said first exit port for receiving said capsule from said reservoir and a second dispensing position wherein said turnstile member capsule-receiving chamber is in registry with said second exit port for dispensing the received capsule from said housing, the corresponding interleaved turnstile member fingers and housing fingers cooperating when said turnstile member capsule-receiving chamber is in said second dispensing position to block further rotation of said turnstile member in said preselected direction until said capsule in said turnstile member capsule-receiving chamber is dispensed through said second exit port.

23. The dispenser of claim 22 wherein said corresponding interleaved turnstile member fingers and housing fingers are in sliding abutment.

24. The dispenser of claim 23 further including means in said housing for orienting elongated capsules in a predetermined orientation prior to feeding said capsule from said reservoir out of said first exit port, said capsule orienting means comprising a propeller member in said reservoir and relatively rotatable therewith, said propeller member having at least one radially extending blade defining a capsule-receiving chamber for orienting said capsule in said predetermined orientation, said propeller member further having means for agitating capsules contained in said reservoir and gravity feeding the agitated capsules to the orienting propeller member capsule-receiving chamber as said propeller member and reservoir are rotated, each propeller member capsule-receiving chamber being rotatable into registry with said first exit port.

25. The dispenser of claim 24 wherein said turnstile member is adapted to maintain said predetermined capsule orientation between said first receiving position and said second dispensing position.

26. The dispenser of claim 25 wherein said reservoir, said propeller member and said turnstile member are coaxially aligned, the capsule-receiving chambers of said propeller member and said turnstile member are longitudinally aligned, and said propeller member and said turnstile member are rotatable in concert.

27. The dispenser of claim 26 wherein said turnstile member has a plurality of arms defining a plurality of capsule receiving chambers, and wherein the turnstile member capsule-receiving chambers are angularly disposed about said turnstile member such that when a first turnstile member capsule-receiving chamber is in registry with said first exit port a second turnstile member capsule-receiving chamber is in registry with said second exit port.

28. The dispenser of claim 27 wherein said first exit port includes a beveled lip portion to lift a capsule in the propeller member capsule receiving chamber out of the path of said first exit port lip as said capsule is rotated by said propeller member blade beyond said first exit port.

29. The dispenser of claim 27 further including a rotatable cap fixed to the axis of said turnstile member and accessible from the exterior of said housing for rotating said turnstile member, and detent means to detain said turnstile member in said first and second positions, said detent means comprising:

a continuous guiding slot about the circumference of one of said cap and housing;

a plurality of detent knobs on the other of said cap and housing slidable in said guiding slot as said cap and housing are relatively rotated;

a plurality of detent slots extending from said guiding slot for receiving said detent knobs and preventing rotation of said cap when said turnstile member is in said first and second positions;

positive action detent means at the juncture of said guiding slot and at least one said detent slots for preventing movement of a detent knob in said preselected direction beyond said detent slot without first sliding at least partially into said detent slot and for preventing movement of a detent knob beyond said detent slot in a direction opposite to said preselected direction; and means for biasing said cap to slide said detent knobs from said guiding slot at least partially into said detent slots, said cap being rotatable in said preselected direction to slide said detent knobs in said guiding slot until one of said detent knobs is stopped by said positive action detent means whereupon said cap biasing means biases said detent knobs into said detent slots thereby preventing further rotation of said cap, said cap being further rotatable by movement of said cap against said biasing means to slide said detent knobs into said guiding slot whereupon said cap is again rotatable in said preselected direction until one of said detent knobs is stopped by said positive action detent means.

30. The dispenser of claim 29 wherein said positive action detent means comprises a spring bayonet having a flexible end extending into said guiding slot at said juncture with said detent slot, said bayonet flexible end in a biased position being disposed at one side of said detent slot to permit a detent knob to slide from said detent slot and into said guiding slot in said preselected direction and to prevent movement of a detent knob in said guiding slot beyond said detent slot in a direction opposite to said preselected direction, said bayonet flexible end being movable by a detent knob sliding in said guiding slot in said preselected direction to a flexed position at the other side of said detent slot to permit a detent knob to be biased into said detent slot while preventing said detent knob from further movement in said guiding slot in said preselected direction.

31. The dispenser of claim 30 wherein two walls extend in a "V"-shape from said guiding slot in said one of said cap and housing and wherein said spring bayonet means is cantilever mounted at the base of said "V" shape, said spring bayonet being in abutment with the wall at one side of said "V" shape in said biased position, said spring bayonet being in abutment with the wall at the other side of said "V" shape in said flexed position.

32. A dispenser for capsules or the like comprising a housing having a reservoir for containing a supply of said capsules, a cap mounted on said housing and relatively rotatable therewith in a preselected position into first and second positions for dispensing said capsules, and detent means to detain said cap in said first and second dispensing positions, said detent means comprising:

a continuous guiding slot about the circumference of said cap;

a plurality of detent knobs on said housing slidable in said guiding slot as said cap and housing are relatively rotated;

a plurality of detent slots extending from said guiding slot for receiving said detent knobs and preventing rotation of said cap in said first and second positions;

positive action detent means at the juncture of said guiding slot and at least one of said detent slots for preventing movement of a detent knob in a preselected direction beyond said detent slot without first sliding at least partially into said detent slot; and means for biasing said cap to slide said detent knobs from said guiding slot at least partially into said detent slots, means for preventing said cap from being rotated in a direction opposite said preselected direction such that said cap is rotatable only in said preselected direction to slide said detent knobs in said guiding slot until one of said detent knobs is stopped by said positive action detent means whereupon said cap biasing means biases said detent knobs into said detent slots thereby preventing further rotation of said cap, said cap being further rotatable by movement of said cap against said biasing means to slide said detent knobs into said guiding slot whereupon said cap is again rotatable in said preselected direction until one of said detent knobs is stopped by said positive action detent means.

33. The dispenser of claim 32 wherein said positive action detent means comprises a spring bayonet having a flexible end extending into said guiding slot at said juncture with said detent slot, said bayonet flexible end in a biased position being disposed at one side of said detent slot to permit a detent knob to slide from said detent slot and into said guiding slot in said preselected direction, said bayonet flexible end being movable by a detent knob sliding in said guiding slot in said preselected direction to a flexed position at the other side of said detent slot to permit a detent knob to be biased into said detent slot while preventing said detent knob from further movement in said guiding slot in said preselected direction.

34. The dispenser of claim 33 wherein said bayonet flexible end in said biased position prevents movement of a detent knob in said guiding slot beyond said detent slot in a direction opposite to said preselected direction.

35. The dispenser of claim 34 wherein two walls extend in a "V"-shape from said guiding slot in said one of said cap and housing and wherein said spring bayonet means is cantilever mounted at the base of said "V" shape, said spring bayonet being in abutment with the wall at one side of said "V" shape in said biased position, said spring bayonet being in abutment with the wall at the other side of said "V" shape in said flexed position.

* * * * *